United States Patent [19]

Bernard et al.

[11] Patent Number: 4,487,636

[45] Date of Patent: Dec. 11, 1984

[54] COLOR CODING OF POWDER METAL PARTS

[75] Inventors: Richard A. Bernard, Norwalk; Anthony A. Alusik, Stratford; Bettadapur S. Ananthamurthy, Norwalk, all of Conn.

[73] Assignee: Pitney Bowes Inc., Stamford, Conn.

[21] Appl. No.: 442,332

[22] Filed: Nov. 17, 1982

[51] Int. Cl.[3] ..... C23F 5/04; B05D 1/36; B05D 7/00

[52] U.S. Cl. ..... 148/6.1; 106/193 D; 106/217; 427/415; 427/417

[58] Field of Search ..... 427/318, 384, 388.5, 427/409, 417, 415, 216, 220; 148/6.1; 106/217, 193 D; 8/522

[56] References Cited

U.S. PATENT DOCUMENTS

| | | | |
|---|---|---|---|
| 1,204,709 | 11/1916 | Snelling | 427/216 |
| 2,012,096 | 9/1935 | Conzetti | 106/193 D |
| 2,649,383 | 8/1953 | Killian et al. | 106/193 D |
| 3,218,243 | 11/1965 | Michelson | 148/6.1 X |
| 3,515,598 | 6/1970 | Schenkel | 148/6.1 |
| 3,639,147 | 2/1972 | Benefiel et al. | 427/409 X |
| 4,162,348 | 7/1979 | Juzu et al. | 427/216 X |
| 4,165,242 | 8/1979 | Kelly et al. | 427/409 X |
| 4,314,005 | 2/1982 | Arias | 427/318 X |

*Primary Examiner*—Michael R. Lusignan

*Attorney, Agent, or Firm*—Melvin J. Scolnick; Albert W. Scribner; William D. Soltow, Jr.

[57] ABSTRACT

A process for color coding of a sintered powder metal part is disclosed. The process comprises contacting said metal part with a color formulation comprising: from about 1 to 10 parts of a colorant, from about 1 to 5 parts of nitrocellulose, up to about 45 parts of an alkyl acetate, and the remainder an alcohol and continuing said contact until a color coating is deposited on said metal part.

24 Claims, No Drawings

COLOR CODING OF POWDER METAL PARTS

This invention relates to color coding of metal parts and, more specifically, to a unique process of color identifying powder metal parts that are to be later assembled.

BACKGROUND OF THE INVENTION

There are known several commercial powder metals for the fabrication of metal parts by sintering, compacting and heat treating. Many of these powder metals are used to make parts to be assembled into final machine products on high speed assembly lines. Others are used to manufacture parts that will be stored for a period of time and used upon need or demand. Often parts are fabricated for eventual assembly, that are similar in appearance, feel and composition. It is desirable that these parts have some distinguishing characteristics that will identify each part as being different from the other similarly shaped parts. Various methods of identification have been used, one of the most common being a color coding of the manufactured parts.

In the color coding of non-metallic parts, there are objections completely different from the color coding of metallic parts. In coloring plastics, for example, the pigment or dyes can be incorporated during the polymerization process and can be chemically bonded within the polymer structure itself. Treatment of these materials by colorants for identification or for decorative reasons can therefore be internal or surface treatment. Problems such as rusting, or color washing or bleeding are not encountered in this type of non-metallic system. Color treatment of this type of molded or laminated plastics is disclosed, for example, in U.S. Pat. No. 2,971,861. In this patent dye-coupling and color developing treatments are employed.

The problems in coloring metals present an entirely different set of objectives and goals. Several methods of coloring metal surfaces are disclosed in the prior art. Just as coloring of resins or plastics differ from coloring of metals, coloring of ferrous compositions differ substantially from the coloring of non-ferrous types of metal formulations. Methods of dying non-ferrous metals such as zinc and galvanized metals are disclosed in U.S. Pat. Nos. 2,393,640 and 4,314,859. In this first patent a corrosion resistant coating is deposited on a zinc and cadmium metal surface by the use of an aqueous acidic solution containing a water soluble chromium compound. The process disclosed in U.S. Pat. No. 4,314,859 also involves the use of chromate material; however, in this process the chromate dye is used in a different color intensity to form the color film. In another known process, to color treat a non-ferrous metal surface such as lead-copper, the inherently colored metal such as copper is coated over the other metal to impart a colored surface. However, in this type of system, one is limited to the color of the coating metal, the only variation being in the intensity of the color. Such a system is disclosed in U.S. Pat. No. 2,033,240.

In these above discussed prior art systems, it is not practical to form multi-colored parts because of the lack of colorants available to impart the color. This is because of the limitations on the types of electrolyzable metals available as coatings, and the limitations on colors possible, i.e., coppery or silvery colors. Also other problems can be present in these coloring systems, such as lack of color intensity, adhesion problems, or metal coating difficulties associated with the electrolyzing process. To minimize these problems, metal color coatings have been combined with chemical dyeing such as in the process described in U.S. Pat. No. 3,405,014. However, these processes have been found to be complex and sometimes difficult to control for uniform coloring.

There are also prior art processes known for the color treatment of ferrous type metallic compositions. In some methods the colorant is surface coated on the ferrous sulfate composition, resulting in a chemical coating such as a metal phthalocyanine. In many of these systems, the coated metal will lose the metallic appearance and will take on the visual appearance of the paint or colorant used. Also, the resistance of the coating to solvents or the atmosphere is often very low. In addition, the coating is generally thick and can chip off or crack when the metal piece is in use or handled. An important further drawback to these used processes is that the coating destroys or reduces the porosity of the surface, thereby making it very difficult to oil impregnate. The desired adhesion qualities of these coatings usually are lacking and their heat resistance is not what is generally desired. To solve these difficulties, various processes have been suggested wherein the ferrous metal surface is chemically converted to a metal porphyrazine or phthalocyanine. In these processes, the finished metal part is immersed in a solution containing a phthalonitrile and at a temperature below the melting point of the metallic surface. After immersion for a period of time, the surface of the metal is converted to the metal porphyrazine. The metal complex thus formed is resistant to cracking and heat, and generally cannot be destroyed. Also, the color imparted can be somewhat varied depending upon the reaction conditions used during the chemical conversion of the metal to the metal complex. Since the coating is part of the metal surface itself, the adhesion qualities are far greater than a chemical surface coating on the metallic part. This type of color coating or conversion process is disclosed in U.S. Pat. No. 2,163,768. The drawback to this prior art color method is that reaction to the desired color intensity of the metallic part is sometimes difficult to control. Also this prior art process does not lend itself to always imparting a uniform coating to the part having the same physical properties. The alteration of the physical characteristics of the part may take place when the entire part is immersed into a strongly reactive chemical solution; for example, parts that are precision fitted can be reduced in size or otherwise modified upon reaction. Furthermore, parts such as threaded screws, bolts or nuts can be adversely affected by a reactive chemical treatment.

SUMMARY OF THE INVENTION

It is therefore an object of this invention to provide a color coding method devoid of the above noted disadvantages.

Another object of this invention is to provide a color coding method for use with sintered powder metal parts which readily permits and does not interfere with oil impregnation of these parts.

Another further object of this invention is to provide a color coding method that is readily adaptable for use with sintered powder metal parts.

Still another object of this invention is to provide a color coding method particularly useful for coloring high strength sintered ferrous metal powder parts.

Yet another object of this invention is to provide a color coding method for coloring sintered powder metal parts wherein a plurality of colors is available for producing multiple colored parts.

Still yet another object of this invention is to provide a method for depositing a colored surface upon a sintered powder metal part wherein the coating is substantially resistant to various lubricants and solvents.

Yet still a further object is to provide a method for forming a colored surface upon a sintered powder metal part wherein the colored coating will not be abrasive to other contacting parts before or after assembly.

An additional and further object is to provide a relatively economical method for color coding sintered metal parts wherein the coating process can be done with readily available commercial equipment.

Another object is to provide a method for forming a relatively insoluble color film coating on sintered powder metal parts wherein the physical properties of the metal parts or composition are not altered after the coating step.

An additional object is to provide a process for color coating a sintered powder metal part wherein the coating is relatively wear resistant, substantially inert to several liquids, and of a color intensity that can readily be recognized.

The foregoing objects and others are accomplished in accordance with this invention by providing a color coating method for sintered powder metal parts which comprises contacting the surface of a powder metal part with a color formulation, said color formulation being an alcohol based solution containing about from 1 to 10 parts of a colorant, about from 1 to 5 parts of wet nitrocellulose, up to about 45 parts of an alkyl acetate, and the remainder an alcohol; parts are by weight unless otherwise specified. The preferred color formulation of this invention comprises 5 parts pigment, 1 part dye, 3 parts wet nitrocellulose, up to 40 parts denatured alcohol, up to 20 parts butyl alcohol, and up to 42 parts butyl acetate. Any suitable materials including the color formulation containing the above ingredients in about the above proportions may be used. The preferred color formulations are known as "Dykem" (which is a registered trademark of the Dykem Company). These Dykem Stains are supplied by the Dykem Company, 8501 Delport Drive, St. Louis, Missouri 63114. In particular, Dykem Stains, Black DXX-553, Green DRJ, Red DNC, Dark Blue DSL, and Yellow DLT were found to be excellent color formulations to be used in the process of this invention. The dry film thickness of the color coating can vary. We have found, however, that the dry film thickness deposited on the surface of the sintered powder metal part should preferably be no more than about 0.0005 inch thick; if it exceeds this thickness, then it can interfere with the required mechanical tolerances of the finished powder metal part. In order to accomplish a thickness at this level, the parts, after being color coated, are placed in a centrifuge until the desired coating thickness results.

Ferrous powder metal alloy parts have presented some difficulties when color coated. Metal compositions of the type disclosed in U.S. Pat. No. 4,170,474 have been used in making metal parts for a variety of commercial machines. Parts made from this material which are similar in appearance and dimension require a distinguishable color from the natural finish in order to permit subsequent ease of assembly. Some of the requirements of such a color coating are that it impart distinguishable color for assembly purposes; be resistant to lubricants and/or solvent cleaners of possible contact during manufacturing and assembly operations; that it not interfere with the porosity of the metal part such that the part can be vacuum impregnated with a lubrication oil; that the film is non-toxic; that the part will not come in contact with acid or alkali type cleaners; that the coating will not be abrasive to other parts after being assembled; that the coefficient of friction (u) will not be affected significantly; however, there will be a generally lower u value; that the coating process can be done with commercial equipment; that the film offers enough wear resistance such that color can be recognized during the handling operation; that the cost of coating process is reasonable; and that a color coating process will not change the physical properties of the powder metal parts.

Numerous materials and various processes were attempted to apply a colorant to the surface of sintered parts made from the powder metal compositions disclosed in U.S. Pat. No. 4,170,474. Most methods used and most materials tried did not meet the requirements for a commercially acceptable coating. Many processes were too costly to be commercially practical or acceptable. Others deposited an unacceptable thickness to the metal surface. Others additionally had poor adhesion, were not readily applied with available equipment, were not chemically compatible, or changed the physical properties of the surface being coated.

In many commercial situations, it is desirable to oil impregnate the parts after color coating treatment. The powder metal compositions of U.S. Pat. No. 4,170,474 after being coated with the Dykem materials above identified and after being air dried surprisingly absorbed 1.3% oil by weight using a vacuum impregnation process. These same parts before color coating by the process of this invention also absorbed the 1.3% oil. This clearly indicated that the process of this invention did not seal off the metal pores, or otherwise alter the oil absorption properties of the metal part.

As stated, the process of this invention can be used to color coat or color treat the surface of sintered powder metal parts containing 1.0 to 2.5% Ni, 0.3 to 0.7% Mo., 0.15 to 0.30% Mn, 0.5 to 1.5% Cu, 0.3 to 0.7% C and the balance Fe. (As in U.S. Pat. No. 4,170,474.) The parts made from this metal composition are heat degreased at a temperature of from about 90° to 120° F. just prior to oil impregnation for five minutes. The parts are then allowed to cool to room temperature.

After coating, the parts are placed into a perforated basket and submerged into a color formulation (depending upon the desired color) containing either the Dykem Yellow DLT, Dykem Black DXX-553, Dykem Green DRJ, Dykem Red DNC, or Dykem Dark Blue DSL for less than about 1 minute. During the submersion of the parts, the color formulation should be agitated or circulated to prevent settling. The parts are then placed into a suitable centrifuge and allowed to spin at about 600 revolutions per minute for at least about two minutes. The parts are then removed from the centrifuge unit and are then oil impregnated to provide good lubrication when in use, and are ready for the assembly line.

The centrifuging of the parts insures that an extremely thin film or color coating will be applied to both smooth and irregular shaped parts.

Since these colored parts may be treated later with various non-acidic solutions, it is important that the coatings be resistant to certain type of solvents. It is particularly important that the color coating be resistant to 1,1,1-trichloroethane, since the process of this invention contemplates a further washing with this solvent.

The table below illustrates the effect of various solvents both acidic and non-acidic on the color coatings resulting from the process of this invention.

| Solvent | DSL Blue | DRJ Green |
|---|---|---|
| Pomeco (1,1,1-trichloroethane) | NE | NE |
| Methanol | RC | RC |
| Ethanol | RC | RC |
| Isopropyl Alc. | NE | NE |
| Toluene | NE | NE |
| Cyclohexane | NE | NE |
| Acetone | RC | RC |
| MEK | RC | RC |
| "Fantastik" | NE | NE |
| "Spritz" (new) Full str. | NE | NE |
| Acetic Acid, Conc. | RC | RC |
| Acetic Acid, Dilute | NE | NE |
| $HNO_3$, Conc. | NE | Darkened spot |
| $HNO_3$, Dilute | NE | NE |
| $H_2SO_4$, Conc. | RC | RC |
| $HNO_3$, Dilute | NE | NE |
| $H_2SO_4$, Conc. | RC | RC |
| $H_2SO_4$, Dilute | NE | NE |
| HCl, Dilute | NE | NE |

NE = No Effect
RC = Removes Completely

DESCRIPTION OF THE PREFERRED EMBODIMENTS

As disclosed above, the preferred material to be used in the process of this invention is a staining color which comprises:

5 parts of a pigment,
1 part of a dye,
3 parts of wet nitrocellulose,
up to 40 parts denatured alcohol,
up to 20 parts butyl alcohol, and
up to 42 parts butyl acetate.

The process should not alter the physical properties of the coated surface after being coated and especially important is the requirement of an unaltered oil absorbing property. The colored coating should be substantially resistant to 1,1,1-trichloroethane. The color should impart distinguishable colors to the surface of the part being treated, and be easily identifiable during the assembly process. Since the colored surfaces must be handled, it is important that they be substantially non-toxic, and not abrasive to humans or other adjacent machine parts.

Various suitable sintered powders such as Fe, Cu, Sn, and Al can be used to make the metal parts of this invention. Sintering is a well defined term known in the art generally as a process of heating metal powders to cause them to agglomerate. Suitable sintered metals and other particulars of the sintering process are disclosed in *Modern Developments in Powder Metallurgy*, by Henry H. Hausner and Pierre V. Taubenblat, 1977 edition.

The following examples illustrate various preferred embodiments of the process of this invention.

EXAMPLE I

Metal machine parts manufactured from a powder composition initially containing about 1.8 parts Ni, 0.6 parts Mo, 0.25 parts Mn, 0.8 parts Cu, 0.50 parts C, 0.75 parts zinc stearate, and the balance being Fe are prepared for color coating. The machine parts are vapor degreased with 1,1,1-trichloroethane for about five minutes. They are then heat treated at a temperature of about 100° F., and then allowed to cool to about room temperature by standing at room temperature. The cooled parts are then placed into a basket in a Barrett Centrifuge and sealed. The Barrett Centrifuge used is a Dipspin or Filwhire Enameler. The Filwhire is preferred where only one type of colorant is being applied. The basketful of parts is set into the machine and the lid is closed. A Dykem staining color containing Dykem Dark Blue DSL pigment and dye (182 m. Blue) is pumped from the supply tank at the rear of the centrifuge machine into the basket through a pipe and hose attached thereto. It is noted that the pigment and dye were pumped while in a well dispersed form. When the container into which the basket is placed is flooded and the parts are completely covered, the pump is shut off and the liquid is drained. The basket is spun at about 600 revolutions per minute and the excess Dark Blue DSL is thrown off the parts and drains back into the supply tank. After spinning for about three minutes, the basket is removed and the parts are put into storage trays. Thereafter drying, the parts are oil impregnated. The thickness of the color coating is measured to be 0.0005 inches thick.

EXAMPLE II

The process of Example I is followed, except the colorant used is a Dykem staining color containing Dykem Yellow DLT, and the coating thickness is 0.0004 inches.

EXAMPLE III

The process of Example I is followed except the colorant used is a Dykem staining color containing Dykem Black DXX-553, and the coating thickness is 0.0002 inches.

EXAMPLE IV

The process of Example I is followed except the colorant used is a Dykem staining color containing Dykem Red DNC, and the coating thickness is 0.0003 inches.

EXAMPLE V

The process of Example I is followed except the colorant used is a Dykem staining color containing Dykem Green DRJ, and the coating thickness is 0.0003 inches. With this particular color, it was noted that extra agitation of the dye and pigment solution might be required to keep them in a well dispersed form.

What is claimed is:

1. A process for color coating of a sintered powder metal part which comprises contacting said metal part with a color formulation comprising: from about 1 to 10 parts of a colorant, from about 1 to 5 parts of nitrocellulose, up to about 45 parts of an alkyl acetate, and the remainder an alcohol and continuing said contact until a color coating is deposited on said metal part, said coating being of a thickness which will not interfere with oil impregnation of said part.

2. The process of claim 1 wherein said coating is continued until a coating of up to about 0.0005 inches is provided on said metal part.

3. The process of claim 1 wherein said metal is a ferrous composition.

4. The process of claim 1 wherein said coating is substantially resistant to and insoluble in 1,1,1-trichloroethane.

5. The process of claim 1 wherein said colorant comprises about 5 parts pigment and about 1 part dye.

6. The process of claim 1 wherein said alcohol comprises up to about 20 parts butyl alcohol and up to 40 parts denatured alcohol.

7. The process of claim 1 wherein said alkyl acetate is butyl acetate.

8. The process of claim 1 wherein said color formulation is Dykem Black XXX-553.

9. The process of claim 1 wherein said color formulation is Dykem Red DNC.

10. The process of claim 1 wherein said color formulation is Dykem Green DRJ.

11. The process of claim 1 wherein said color formulation is Dykem Dark Blue DSL.

12. The process of claim 1 wherein said color formulation is Dykem Yellow DLT.

13. A process for color coating a sintered metal part made from a powder alloy composition comprising Fe, Ni, Mo, Mn, Cu, C, and zinc stearate, said process comprising degreasing said metal part and contacting said part with a color formulation to thereby deposit a surface film on said part, said film being of a thickness which will not interfere with oil impregnation of said part, said color formulation selected from the group consisting of Dykem Black DXX-553, Dykem Red DNC, Dykem Green DRJ, Dykem Dark Blue DSL, Dykem Yellow DLT, and mixtures thereof.

14. The process of claim 13 wherein said metal is a ferrous composition.

15. The process of claim 13 wherein said coating is continued until a coating of up to about 0.0005 inches is provided on said metal part.

16. The process of claim 13 wherein said metal part is cooled to room temperature prior to contact with said color formulation.

17. The process of claim 13 wherein said metal part is oil impregnated after formation of said film.

18. The process of claim 13 wherein said surface film is substantially resistant to 1,1,1-trichloroethane.

19. The process of claim 13 wherein said sintered metal alloy comprises about:

1.8 parts Ni
0.6 parts Mo
0.25 parts Mn
0.6 parts C
0.8 parts Cu
and the remainder being Fe.

20. The process of claim 19 wherein said color formulation is Dykem Black DXX-553.

21. The process of claim 19 wherein said color formulation is Dykem Red DNC.

22. The process of claim 19 wherein said color formulation is Dykem Dark Blue DSL.

23. The process of claim 19 wherein said color formulation is Dykem Yellow DLT.

24. The process of claim 19 wherein said color formulation is Dykem Green DRJ.

* * * * *